US009599312B2

(12) United States Patent
Chen

(10) Patent No.: US 9,599,312 B2
(45) Date of Patent: Mar. 21, 2017

(54) PORTABLE LAMP

(71) Applicant: TSAIR YIH INDUSTRIAL CO., LTD., Kaohsiung (TW)

(72) Inventor: Yu-Ta Chen, Kaohsiung (TW)

(73) Assignee: TSAIR YIH INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 14/803,103

(22) Filed: Jul. 19, 2015

(65) Prior Publication Data

US 2016/0025283 A1 Jan. 28, 2016

(30) Foreign Application Priority Data

Jul. 22, 2014 (TW) ..... 103213057 U

(51) Int. Cl.

| | |
|---|---|
| ***F21V 9/08*** | (2006.01) |
| ***F21V 7/00*** | (2006.01) |
| ***F21V 21/14*** | (2006.01) |
| ***F21L 4/00*** | (2006.01) |
| ***F21V 13/14*** | (2006.01) |
| *F21V 21/40* | (2006.01) |
| *F21V 23/04* | (2006.01) |
| *F21V 21/08* | (2006.01) |
| *F21S 9/02* | (2006.01) |
| *F21Y 101/00* | (2016.01) |

(52) U.S. Cl.

CPC ..... *F21V 9/083* (2013.01); *F21L 4/00* (2013.01); *F21V 7/0066* (2013.01); *F21V 7/0075* (2013.01); *F21V 13/14* (2013.01); *F21V 21/145* (2013.01); *F21S 9/02* (2013.01); *F21V 7/0008* (2013.01); *F21V 21/0832* (2013.01); *F21V 21/406* (2013.01); *F21V 23/0414* (2013.01); *F21Y 2101/00* (2013.01)

(58) Field of Classification Search

CPC ..... F21V 9/083; F21V 7/0066; F21V 7/0075; F21V 7/008; F21V 12/14; F21V 21/145; F21V 21/0832; F21V 21/406; F21V 23/0414

USPC ..... 362/190, 191

See application file for complete search history.

(56) References Cited

U.S. PATENT DOCUMENTS

| | | | | |
|---|---|---|---|---|
| 4,754,376 A * | 6/1988 | Winslow | F21S 9/02 | 362/154 |
| 5,010,454 A * | 4/1991 | Hopper | B60Q 3/007 | 362/183 |
| 8,408,733 B2 * | 4/2013 | Nelson | F16M 11/10 | 362/191 |
| 8,585,260 B2 * | 11/2013 | Hajee | F21S 9/032 | 362/190 |

(Continued)

*Primary Examiner* — Laura Tso

(74) *Attorney, Agent, or Firm* — Leong C. Lei

(57) ABSTRACT

A portable lamp, mainly includes a framework, reflecting seat, power box and positioning mechanism, where the reflecting seat is configured on the inner edge of one side of the framework, the power box is coupled pivotally inside the framework through the positioning mechanism and can be rotated relatively to the framework and positioned through the positioning mechanism, and the power box has a light emitting unit which can be rotated with the power box and illuminate toward the reflecting seat or in other directions, thereby allowing the present invention to form a lamp capable of the adjustment of an illumination direction.

8 Claims, 13 Drawing Sheets

(56) References Cited

U.S. PATENT DOCUMENTS

| | | | | |
|---|---|---|---|---|
| 2009/0109664 | A1* | 4/2009 | Halasz | F21L 4/00 362/190 |
| 2010/0008080 | A1* | 1/2010 | Vinther | F21V 21/30 362/190 |
| 2014/0146552 | A1* | 5/2014 | Hui | F21V 23/0442 362/473 |
| 2014/0313706 | A1* | 10/2014 | Itoh | F21V 21/30 362/184 |

* cited by examiner

PORTABLE LAMP

TECHNICAL FIELD OF THE INVENTION

The present invention relates to a lamp, and more particularly to a lamp structure capable of changing a light projection direction.

DESCRIPTION OF THE PRIOR ART

Illuminating lamps are almost indispensible in daily life; they are convenient not only for carrying but in use. Almost each and every family equips with illuminating lamp(s). Especially, camping lights not only provide illumination but security. In addition, general technicians need illuminating lights to carry out outdoor repair during night or in dark.

Therefore, there are many market available light and small lamps, such as portable lamps or hanging lamps, a general use manner of which is using one hand to hold an illumination lamp, and aiming the illuminating light bulb thereof in a direction requiring illuminated or at an object, allowing light to project on a target so that the target can be seen clearly. However, such kind of use manner is very inconvenient for a user working with both hands such that some user will place the illuminating light on a plane so as to spare the two hands to work. But, light beams emitted from an illuminating light are parallel beams, which is liable to have a situation that the placement plane cannot conform to a required illumination direction and would prevent the operation from being carried out.

SUMMARY OF THE INVENTION

To solve the problem of conventional portable lamps being incapable of the adjustment of illumination direction, the present invention is proposed.

Therefore, the present proposes a portable lamp, mainly comprising:

a framework, having two first frame bodies spaced apart from each other, and two second frame bodies spaced apart from each other and respectively positioned between the first frame bodies and connected therewith, one of the first frame bodies being configured with a mounting hole;

a reflecting seat, configured inside one of the second frame bodies;

a power box, being hollow, a lamp hole being configured on one side thereof corresponding to one of the second frame bodies, at least one control circuit, light emitting unit and battery slot being configured inside the power box, the light emitting unit, battery slot being in electric connection with the control circuit, and one side of the light emitting unit being retained to the lamp hole; and a positioning mechanism, having at least one external shaft fixed to the mounting hole of the framework and at least one internal shaft fixed to one side of the power box, the power box being coupled pivotally to the external shaft through the internal shaft and positioned inside the framework, the external shaft being configured with a plurality of separated first positioning portions, the internal shaft being configured with at least one second positioning portion.

When the power box is pivoted, the internal shaft is rotated therewith to cause the second positioning portion to separate from the first positioning portion of the external shaft, and when the second positioning portion of the internal shaft is rotated to another first positioning portion, the second positioning portion falls into the first positioning portion to be positioned by means of the elastic support of the material of which the internal shaft is made.

It is stressed specifically here that the power box with a light emitting unit of the present invention is coupled pivotally inside the framework through the positioning mechanism and can be rotated with respect to the framework as well as positioned through the positioning mechanism; the present invention can be placed on a proper position through the framework, and the side of the power box that the light emitting unit is located is then turned to position at a radiation required direction, further achieving the object of adjusting various illumination angles.

DETAILED DESCRIPTION OF THE PREFERRED EMBODIMENTS

Figure 1:
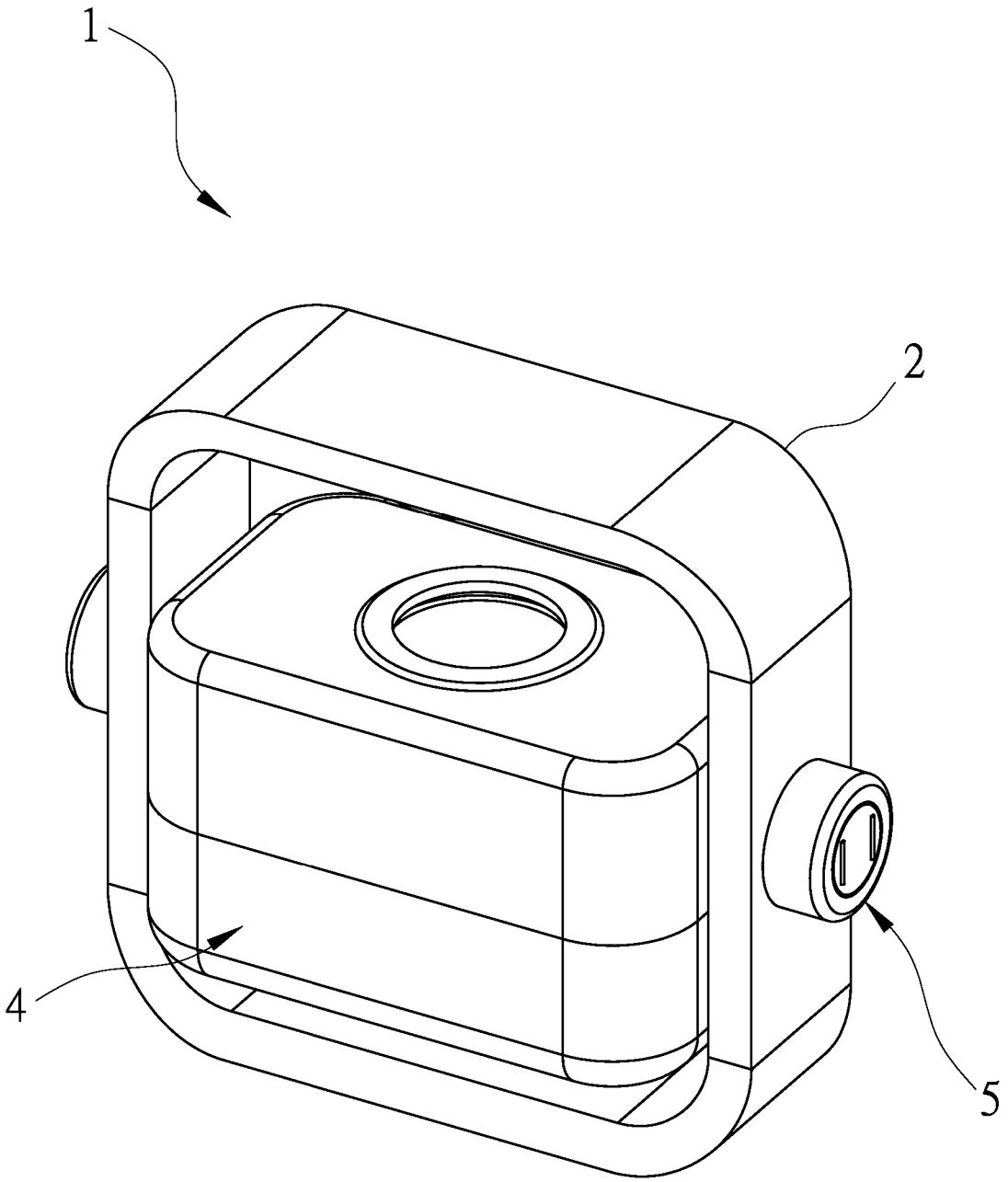
FIG. 1 is a perspective view of the present invention.
Figure 2:
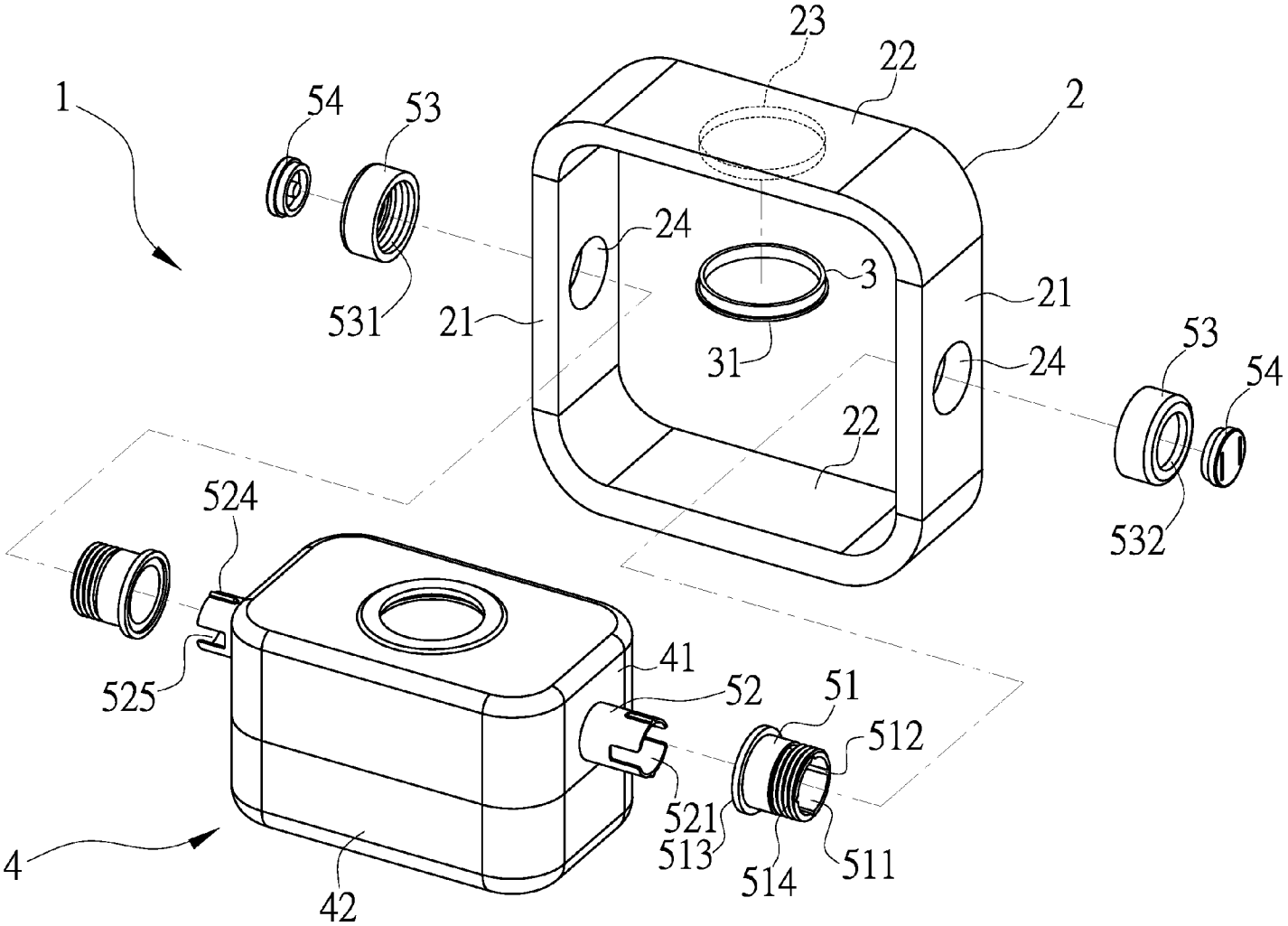
FIG. 2 is an exploded view of the present invention.
Figure 3:
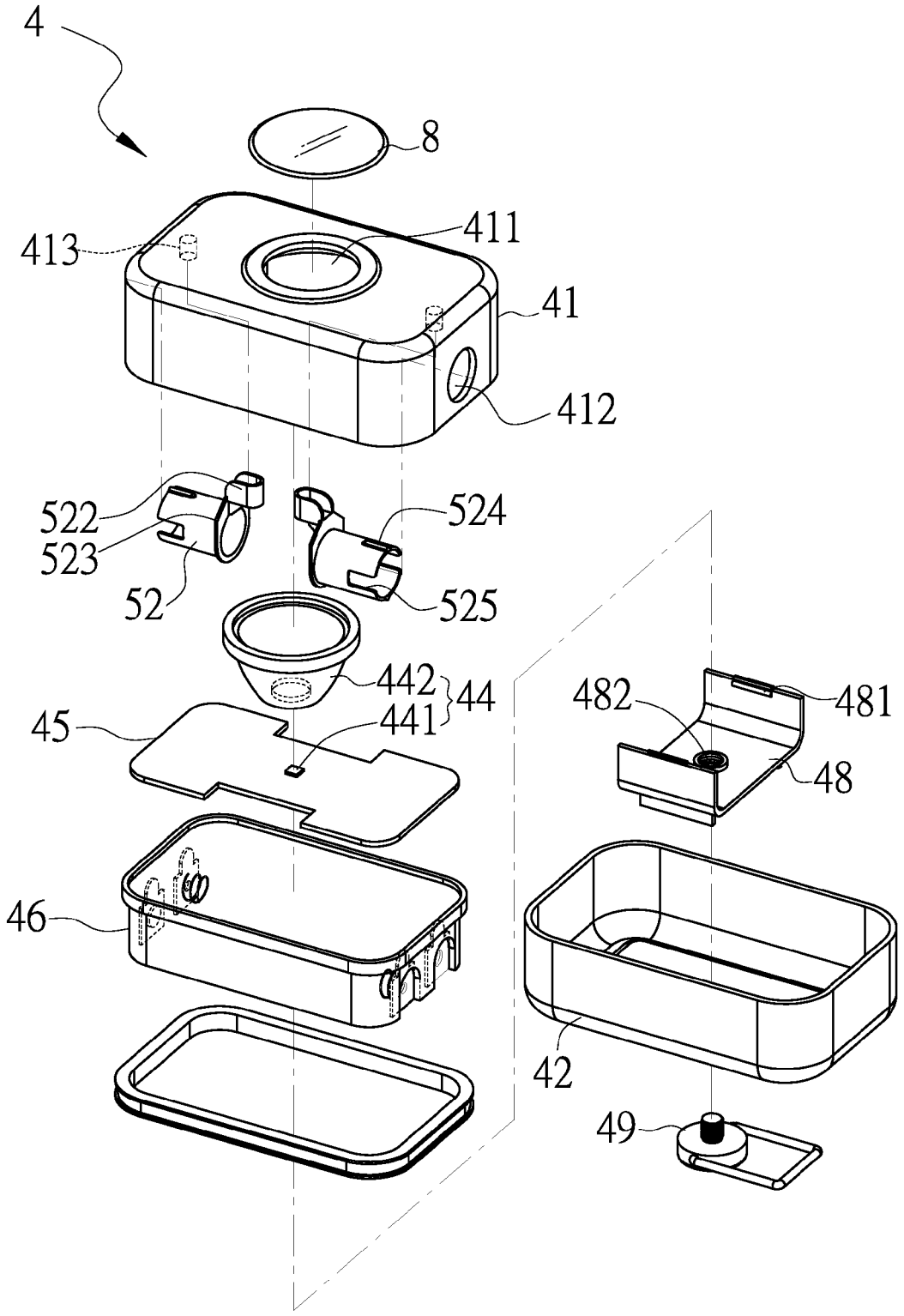
FIG. 3 is an exploded view of a power box according to the present invention.
Figure 4:
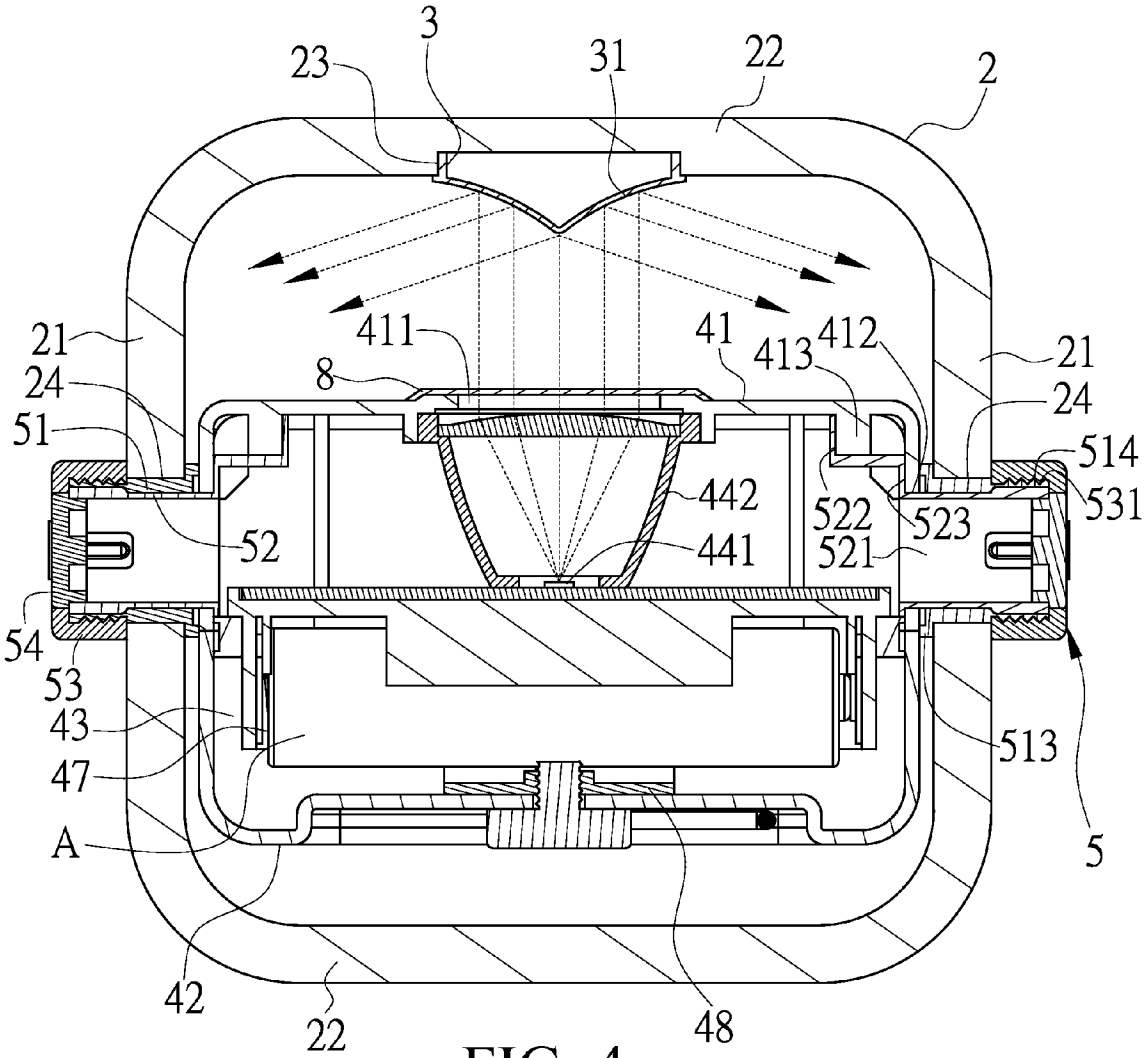
FIG. 4 is a cross-sectional view of the present invention.

Referring to FIGS. 1 to 4, which respectively are perspective, partly exploded, partly exploded and cross-sectional views of a preferred embodiment of a portable lamp according to the present invention, a lamp 1 mainly includes a framework 2, a reflecting seat 3, a power box 4 and a positioning mechanism 5.

The framework 2 has two first frame bodies 21 spaced apart from each other and two second frame bodies 22 connecting the two first frame bodies 21 to each other and spaced apart from each other, where the inner edge of one of the second frame bodies 22 is configured with a groove 23, and each of the first frame bodies 21 a mounting hole 24. In the embodiment, the first frame bodies 21 and second frame bodies 22 all respectively are a plate-typed body for explanation but not limitation, and the connections thereof all respectively are a circularly-arched connection.

Furthermore, the reflecting seat 3 is fixed to the groove 23 of the second frame body 22, including a reflection portion 31 extended from the reflecting seat 3 toward the inside of the framework 2. Here, the reflecting portion 31 exemplifies a conical body for convenient explanation.

Furthermore, the power box 4 has a upper housing 41 and lower housing 42 engaged with each other to form and define a receiving space 43 inside; a lamp hole 411 is configured on one wall of the upper housing 41 corresponding to one of the second frame bodies 22. Furthermore, the two wall faces of the upper housing 41 perpendicular to the axial direction of the lamp hole 411 are respectively configured with an axle hole 412, and a projecting rod 413 is configured on the two positions of the wall of the upper housing 41 where the lamp hole 411 is located close to the each axle hole 412. Furthermore, a light emitting unit 44, control circuit 45, base 56 and a battery slot 47 are configured in sequence between the two housings in a direction form the upper housing 41 toward the lower housing 42, where the control circuit 45 is a substrate configured above the base 46, the battery slot 47 between the base 46 and lower housing 42, and the light emitting unit 44 and battery slot 47 respectively are in electric with the control circuit 45, where the light emitting unit 44 includes a light emitting element 441 and a lampshade 442 which is covered on the outside of the light emitting element 441 and one side of which is fixed to the lamp hole 411. In addition, a yellow cover capable of filtering light beams with a wavelength below 500 nm may further be configured on the outer rim of the lamp hole 411, allowing light emitted from the light emitting element 44 to become warm light through the yellow cover 8, thereby filtering the light beams with a wavelength that mosquitoes favor most, causing them to lose sight, and thereby to achieve a mosquito repellent effect.

The positioning mechanism 5 at least has an external shaft 51, internal shaft 52, shaft sleeve 53, and hole plug 54, where the external shaft 51 is a tube-typed body and a through hole 511 is configured in the axial direction thereof, where the hole wall of the through hole 51 is configured with a plurality of separated first positioning portions 512, and the circumference of one end of the external shaft 51 is configured with a shoulder portion 513; the external shaft 51 is passed through the mounting hole 24 of the framework 2, and the shoulder portion 513 is pressed against the inner side of the first frame body 21; the other end of the outer shaft 51 exposed out of the framework 2 is configured with external threads 514; the shaft sleeve 53 has internal threads 531, and a receiving hole 532 in communication with the through hole 511 is configured on the shaft sleeve 53 in the axial direction of the external shaft 51, the shaft sleeve 53 being engaged with one end of the external shaft 51, thereby to retain the external 51 to the first frame body 21. Furthermore, the hole plug 54 is mounted on the receiving hole 532 to shield the through hole 511 of the external shaft 511. Furthermore, the internal shaft 52 is passed through the axle hole 412 of the upper housing 41 and has a passage 521 in the axial direction thereof; one end of the internal shaft 52 positioned inside the upper housing 41 is configured with a socket portion 522 adapted to put around the projecting rod 413, and the outer edge of the passage 521 is projected with an abutting portion 523, which is in connection with the socket portion 522 and one side of which is pressed against the inner edge of the upper housing 41; the other side of the internal shaft 52 is exposed out of the upper housing 41 and inserted in the through hole 511 of the external shaft, the outer edge of the internal shaft 52 is configured with a second positioning portion 524 corresponding to one of the first positioning portions 512, and the side of the internal shaft 52 where the second positioning portion 524 is located being configured with a radial notch 525.

Connection therewith, the positioning mechanism 5 may be configured on one single side of the power box 4, or may respectively be configured on the two opposite sides of the power box 4. If the positioning mechanism 5 is configured on one single side of the power box 4, the opposite side thereof may assist the pivoting of the power box 4 by passing a pivoting shaft (not shown in the figures) through the mounting hole 24 of the framework 2 and the axle hole 412 of the upper housing 41.

Figure 5:
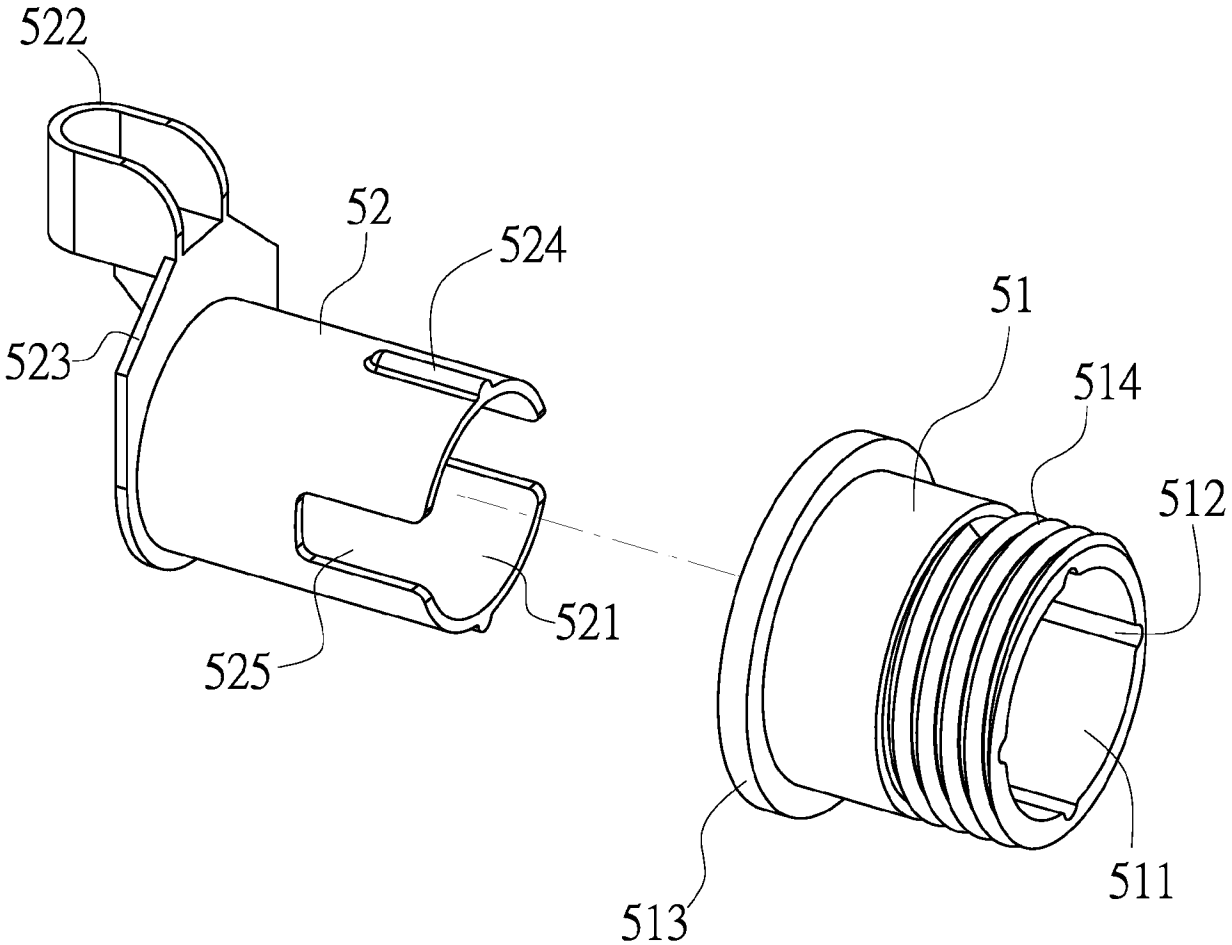
FIG. 5 is a partly exploded view of a positioning mechanism according to the present invention.
Figure 6A:
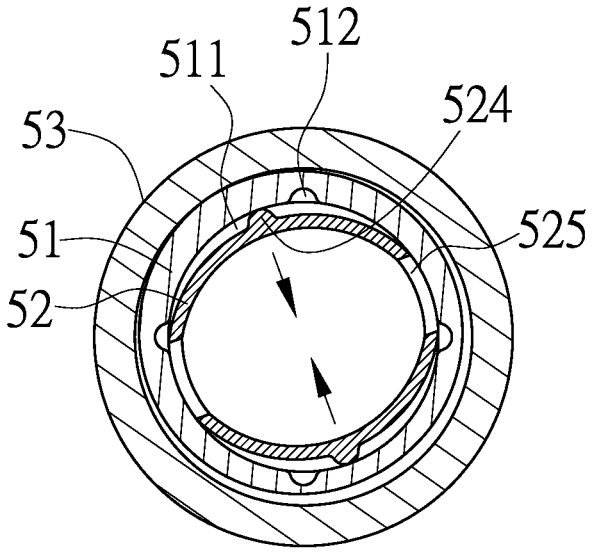
FIGS. 6*a* and 6*b* respectively are a cross-sectional view of the positioning mechanism in continuous action.
Figure 6B:
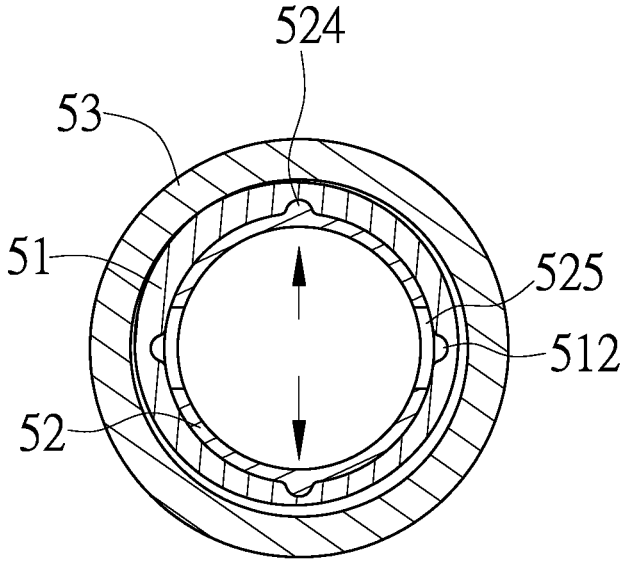
Figure 7:
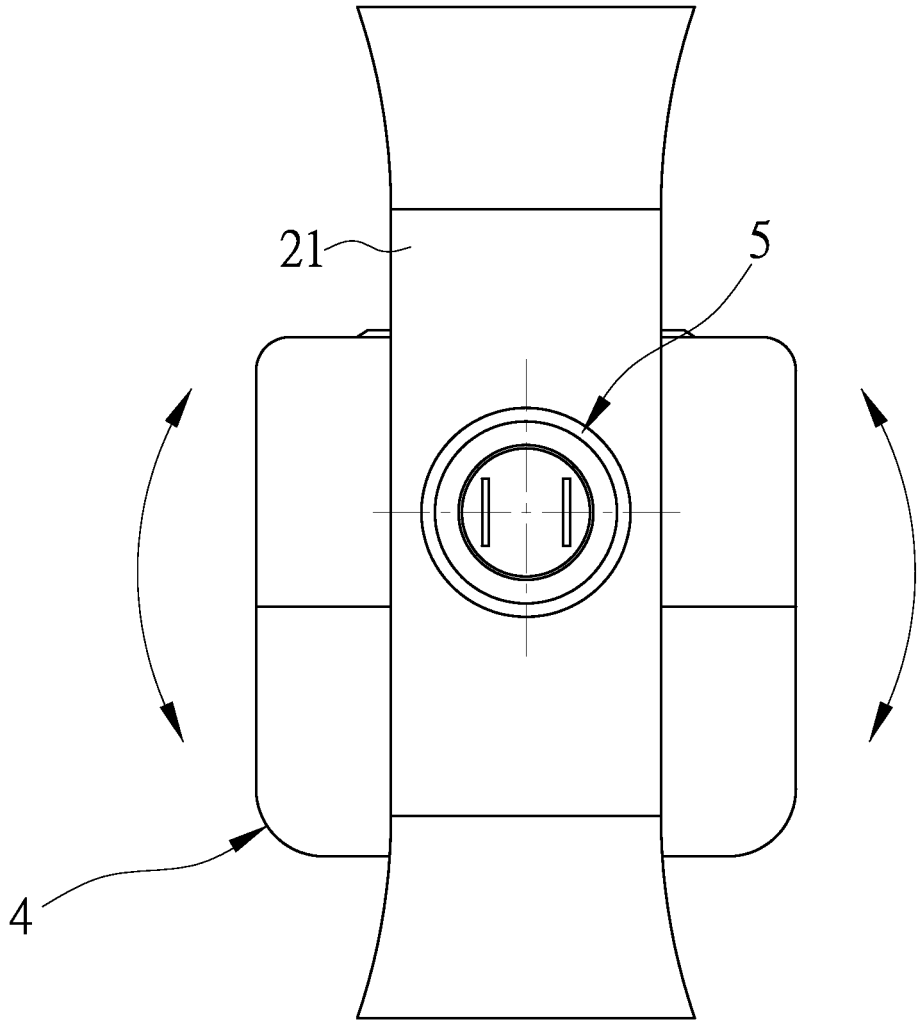
FIG. 7 is a side plan view of the present invention.

Referring to FIGS. 5 to 7, the power box 4 is pivoted inside the framework 2 through the positioning mechanism 5. In the embodiment, the first positioning portion 512 is an arc groove, and the second positioning portion 524 is an arc convex portion with respect thereto. It is noted here that the number of the first positioning portion 512 may be increased or decreased according to design requirements, while the second positioning portions 524 number at least one; the embodiment exemplifies two. Accordingly, when light emitted from the light emitting unit 44 is projected toward to the reflecting seat 3, it will be spread around by means of the reflection of the reflecting portion 31, thereby increasing the illumination range of the lamp according to the present invention.

In addition, when the power box 4 is pivoted, the socket portion 522 of the internal shaft 52 is pressed against by the projecting rod 413 to thus drive the internal shaft 52 to move to force the second positioning portion 524 to release from the first positioning portion 512 of the external shaft 51, and at the same time, the radial notch 525 positioned at one side of the second positioning portion 524 of the internal shaft 52 can cause a contraction space to be formed (see the arrow direction shown in FIG. 6*a*), allowing the internal shaft 52 to be turned inside the through hole 511. Thereafter, the second positioning portion 524 is pressed outward by the resilience of the material forming the internal shaft 52 to fall into the other first positioning portion 512 when the second positioning portion 524 of the internal shaft 52 is turned to that first positioning portion 512, thereby achieving the illumination direction adjustment.

Figure 8:
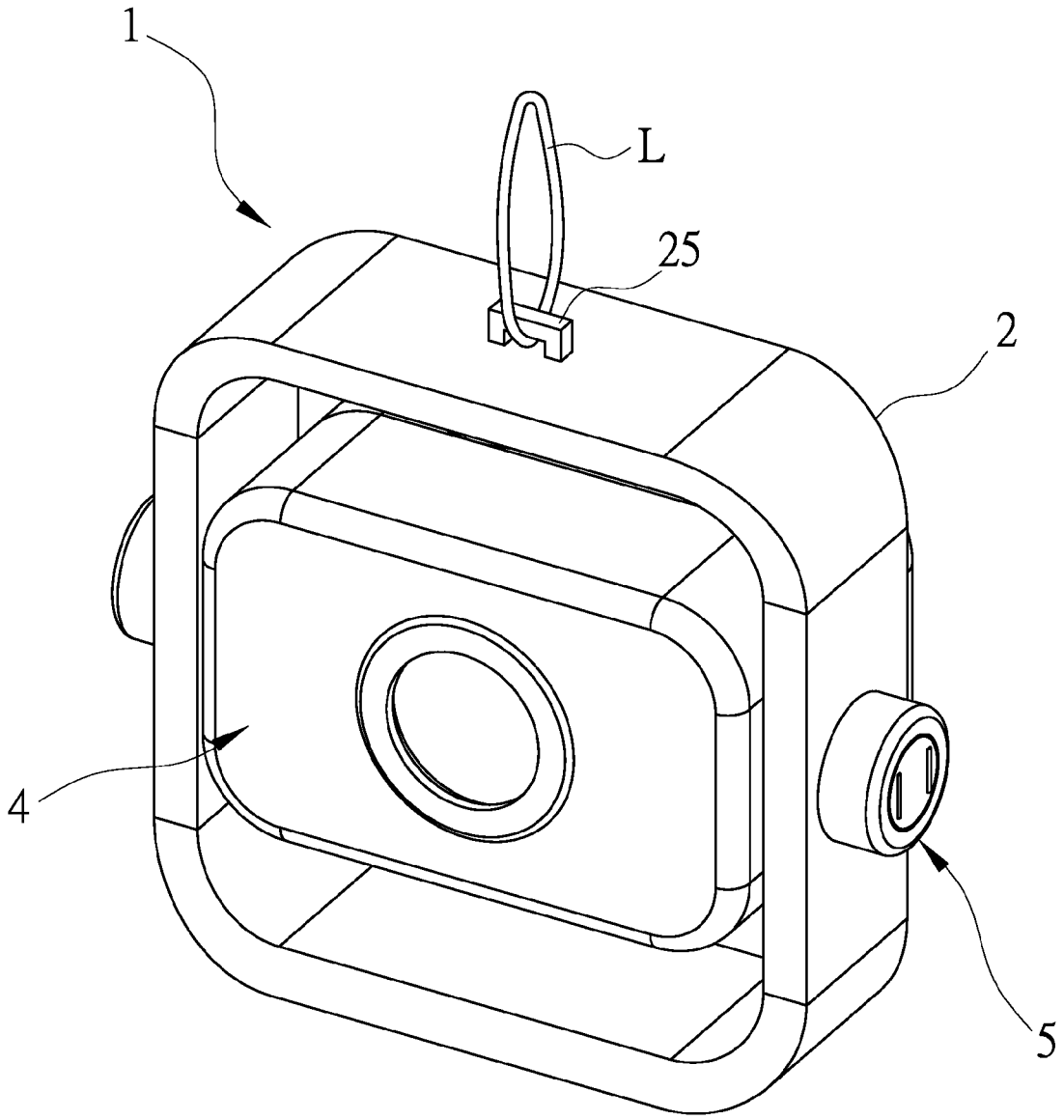
FIG. 8 is a perspective view of the present invention.

Next, referring to FIG. 8, to allow the present invention to be used in various environments, the framework 2 may be configured with a hanging portion 25, which may be fixed to either the first frame body 21 or the second frame body 22. The hanging portion 25 is a ringlike body for the hanging of the lamp on a hook, or a coilable line body L may be passed through it for hanging.

Figure 9:
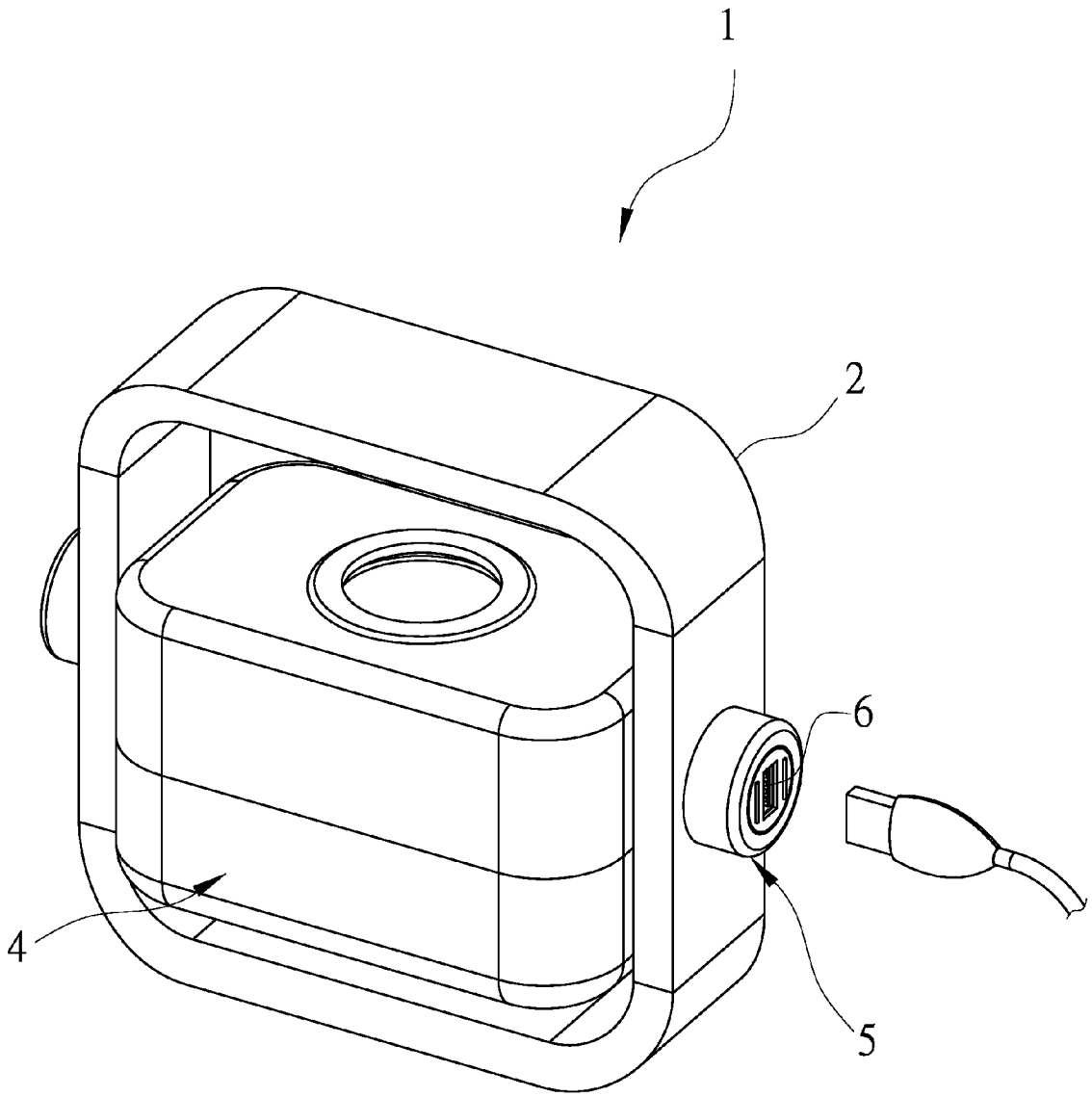
FIGS. 9 and 10 respectively are a perspective view of a preferred embodiment according to the present invention.
Figure 10:
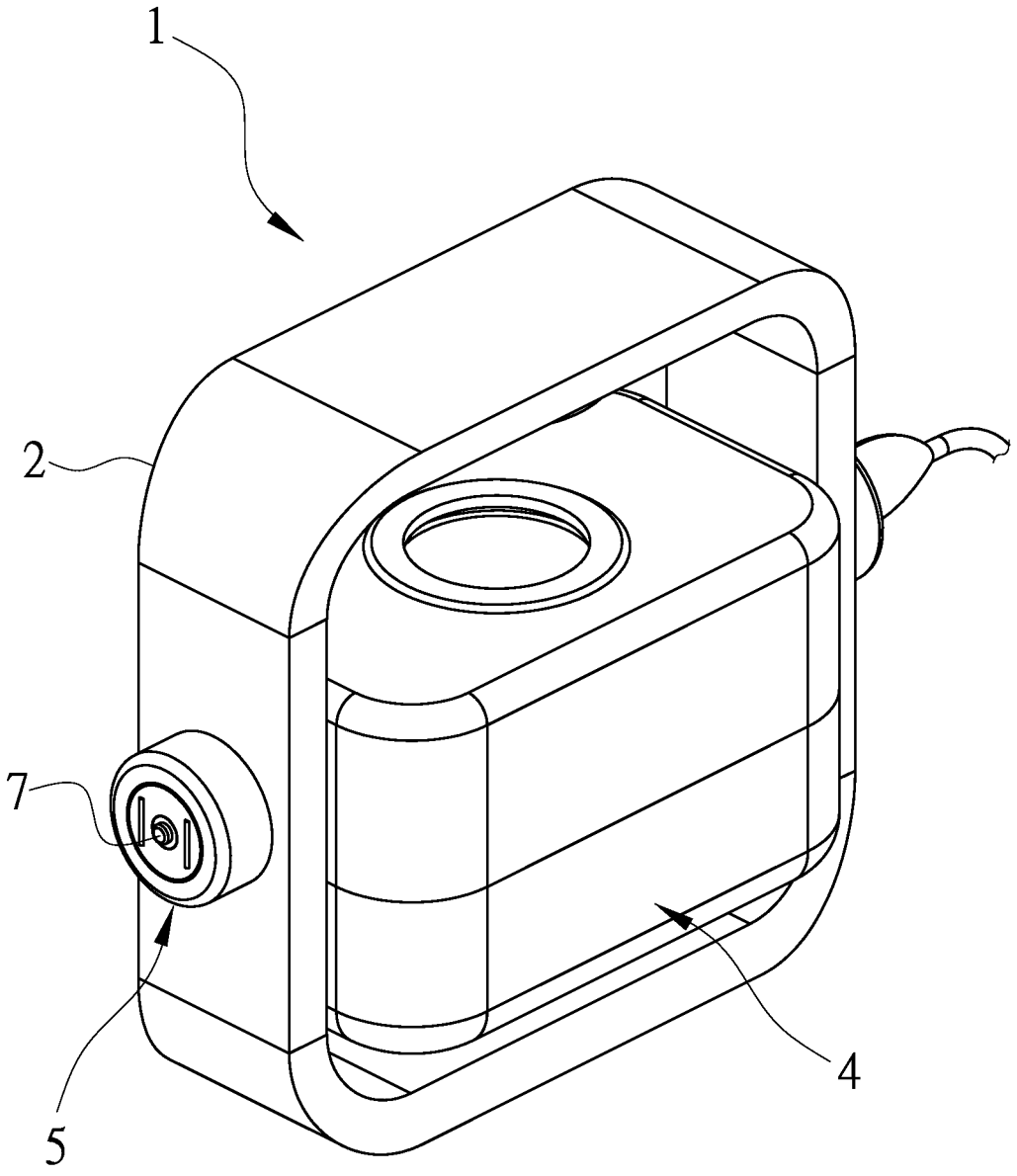
Figure 11:
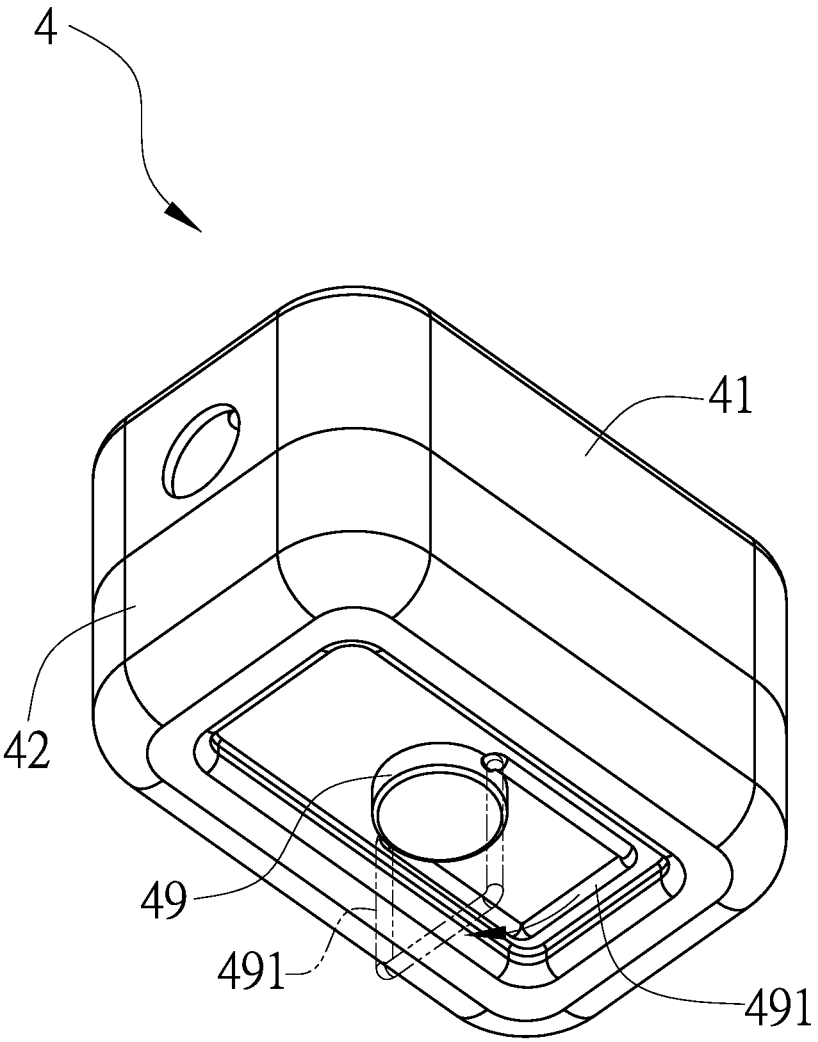
FIGS. 11 and 12 respectively are a schematically perspective view and a schematically exploded view of the power box in a use state.
Figure 12:
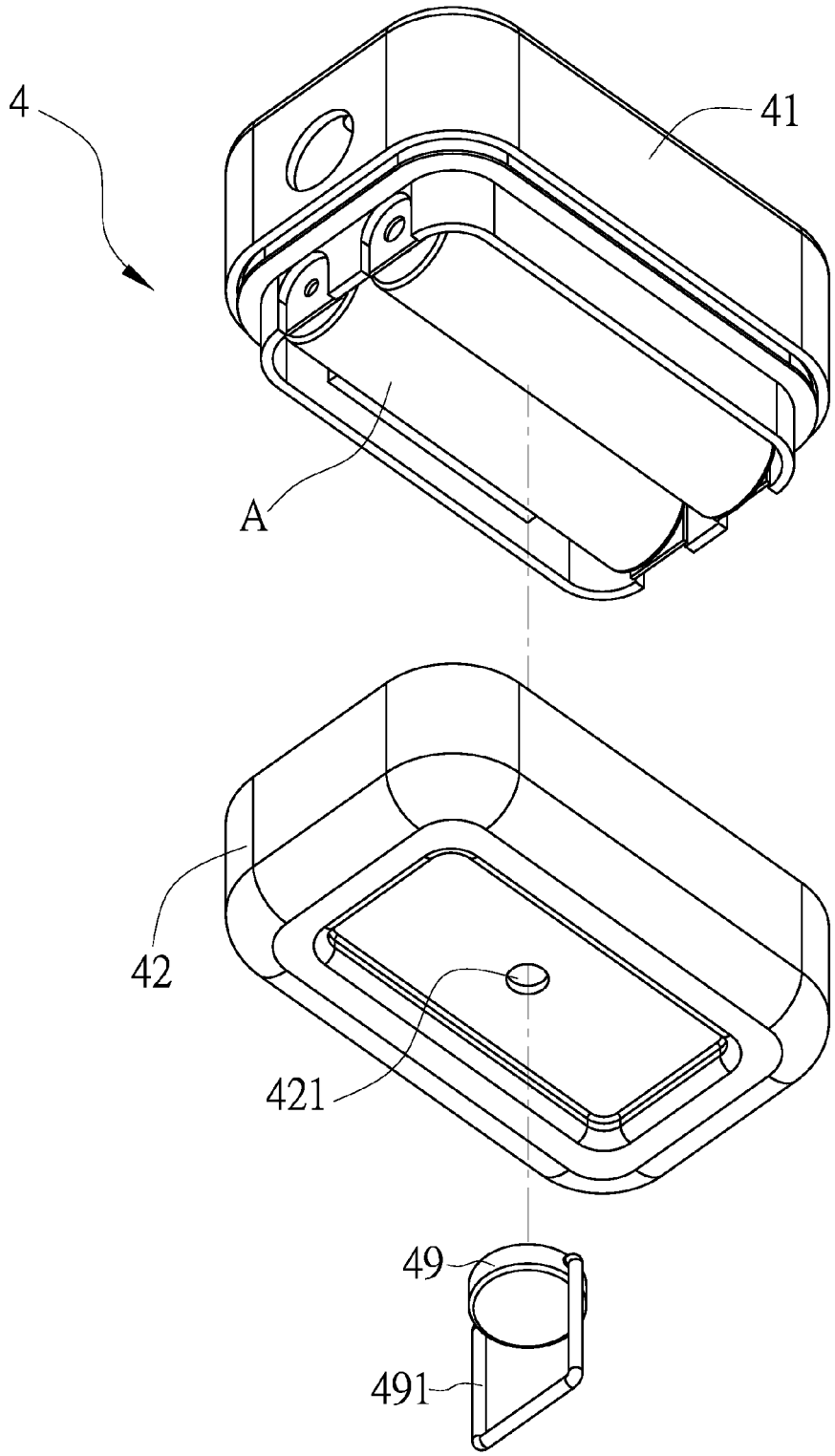

Furthermore, referring to FIGS. 9 and 10, a USB slot 6 in electric connection with the control circuit 45 is configured on one side of the positioning mechanism 5. In the embodiment, the USB slot 6 is configured on the hole plug 54 and mainly adapted to carry out power charging by means of the rectification of the control circuit 45 so as to be convenient to be used anytime and anywhere, and particularly suitable for outdoor. Furthermore, the lamp 1 further has a push switch 7 configured on the hole plug 54 of the positioning mechanism 5, which is in electric connection with the control circuit 45 and allows the light emitting unit 44 to be turned on or off through it.

Furthermore, referring to FIGS. 3, 4, 11 and 12, the power box 4 is further configured with a clamping element 48 and a screw 49, where the clamping element 48 is a U-typed body, and the two sides of the opening of the U-typed body are respectively configured with a flange 481; the space defined by the bottom and the flanges 481 are used to frame and clamp the outer edge of the battery A1; the bottom of the clamping element 48 is configured with a screwhole 482, and a through hole 431 corresponding thereto is configured on the lower housing 42, whereby the screw 49 is passed through the through hole 421 from the outside of the lower housing 42 to engaged with the screwhole 482 of the clamping element 48, thereby to retain the lower housing 42 to the clamping element 48. In addition, a grip 491 is coupled pivotally to the head of the screw 49, the grip 491 being parallel to the bottom of the lower housing 42 in a folding state. Upon the replacement of the battery, a user may pivot the grip 491 relatively to the screw 49 to cause it to be perpendicular to the lower housing 42, and the screw 49 can then be loosen to allow the lower housing 42 to be separated from the upper housing 41, thereby carrying out the replacement of the battery A.

Figure 13:
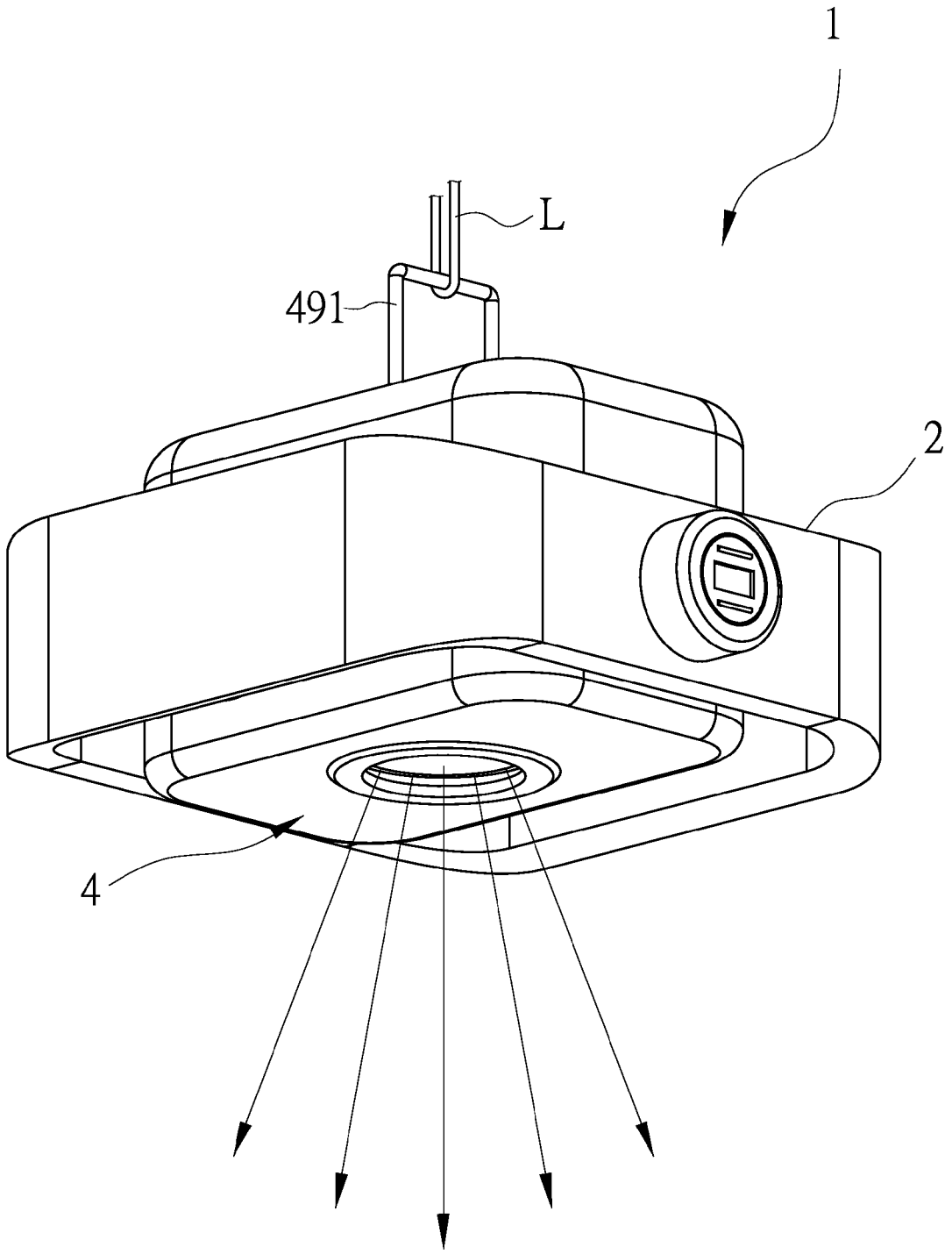
FIG. 13 is a schematically perspective of the present invention upon hanging.

Finally, referring to FIG. 13, the grip 491 may be pivoted to cause it to be perpendicular to the lower housing 42 when the poser box 4 is pivoted by an angle, and the grip 49 or the line body L passed through the grip 491, if any, is then hung on a hook, thereby allowing light to be projected downward.

I claim:

1. A portable lamp, comprising:

a framework, having two first frame bodies spaced apart from each other, and two second frame bodies spaced apart from each other and respectively positioned between said first frame bodies and connected therewith, one of said first frame bodies being configured with a mounting hole;

a reflecting seat, configured inside one of said second frame bodies;

a power box, being hollow, a lamp hole being configured on one side thereof corresponding to one of said second frame bodies, at least one control circuit, light emitting unit and battery slot being configured inside said power box, said light emitting unit, battery slot being in electric connection with said control circuit, and one side of said light emitting unit being retained to said lamp hole; and a positioning mechanism, having at least one external shaft fixed to said mounting hole of said framework and at least one internal shaft fixed to one side of said power box, said power box being coupled pivotally to said external shaft through said internal shaft and positioned inside said framework, said external shaft being configured with a plurality of separated first positioning portions, said internal shaft being configured with at least one second positioning portion, and said second positioning portion being fallen into or released from said first positioning portion for positioning by means of rotation.

2. The portable lamp according to claim 1, wherein said external shaft is passed through said mounting hole and configured with a through hole in an axial direction of said mounting hole, each said first positioning portion is configured on a hole wall of said through hole, a shoulder portion pressed against an inner side of said framework is configured on one end of said external shaft facing said power box, and another end thereof is exposed out of said framework and configured with external threads, said positioning mechanism further has a shaft sleeve with internal threads and a hole plug, said shaft sleeve is engaged with said external threads of said external shaft, thereby to limit an toroidal rotation of said external shaft, said hole plug is configured on one side of said shaft sleeve to seal said through hole of said external shaft, and one side of said internal shaft is coupled pivotally to said through hole of said external shaft.

3. The portable lamp according to claim 1, wherein said power box has a upper housing and lower housing engaged with each other, said lamp hole is configured on said upper housing, an axle hole is configured on one side of said upper housing corresponding to said positioning mechanism, said internal shaft is passed through said axle hole, one side of said internal shaft is fixed inside said upper housing, and another side thereof is exposed out of said upper housing and coupled pivotally to said external shaft.

4. The portable lamp according to claim 1, wherein said light emitting unit comprises a light emitting element and a lampshade, said lampshade is covered on said light emitting element, and one side of said lampshade is fixed to said lamp hole.

5. The portable lamp according to claim 1, wherein said framework is configured with a hanging portion.

6. The portable lamp according to claim 1, further configured with a push switch in electric connection with said control circuit.

7. The portable lamp according to claim 1, wherein one side of said positioning mechanism is a USB slot in electric connection with said control circuit.

8. The portable lamp according to claim 1, wherein an outer edge of said lamp hole is configured with a yellow cover capable of filtering light with a wavelength below 500 nm.

* * * * *